US007216459B1

(12) United States Patent
Akkala et al.

(10) Patent No.: US 7,216,459 B1
(45) Date of Patent: May 15, 2007

(54) ACCESS HATCH COVER ASSEMBLY WITH LIFT-ASSIST ASSEMBLY AND METHOD THEREFOR

(75) Inventors: Steven M. Akkala, Neenah, WI (US); Elizabeth L. Remme, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 215 days.

(21) Appl. No.: 10/613,291

(22) Filed: Jul. 2, 2003

(51) Int. Cl.
*E02D 29/14* (2006.01)

(52) U.S. Cl. ..... 52/20; 49/386; 16/285

(58) Field of Classification Search ..... 52/19, 52/20; 49/386, 387, 400; 16/285; 292/32, 292/132, 163, 164, 170, DIG. 11, DIG. 61; 220/827, 830, 254.5
See application file for complete search history.

(56) References Cited

U.S. PATENT DOCUMENTS

| | | | | |
|---|---|---|---|---|
| 4,101,236 | A | 7/1978 | Meyer | |
| 4,279,356 | A | 7/1981 | Amorese et al. | |
| 4,534,132 | A * | 8/1985 | Smith | 49/386 |
| 4,673,310 | A | 6/1987 | LeBaron | |
| 4,690,584 | A | 9/1987 | LeBaron | |
| 4,781,008 | A | 11/1988 | Lyons, Jr. | |
| 4,840,171 | A * | 6/1989 | Rohling et al. | 128/204.18 |
| 4,976,568 | A * | 12/1990 | Hess | 404/26 |
| 4,997,218 | A * | 3/1991 | Culling | 292/60 |
| 5,082,392 | A | 1/1992 | Marchese et al. | |
| 5,201,151 | A | 4/1993 | LeBlanc et al. | |
| 5,531,541 | A | 7/1996 | Clover et al. | |
| 5,715,965 | A * | 2/1998 | Goulding | 220/321 |
| 5,732,512 | A | 3/1998 | Ueno et al. | |

(Continued)

OTHER PUBLICATIONS

U.S.F. Fabrication, Floor Access Doors, Grating and Misc. Metal Fabrication, Date Unknown, 68 pages (10 sent), Hialeah, FL, U.S.
U.S.F. Fabrication, Airport Products, Date Unknown, 4 pages, Hialeah, FL, U.S.
Glynwed Brickhouse, Access Covers and Gratings (Torlift), Date Unknown, 3 pages, WEst Midlands, U.K.
Saint-Gobain, PAM-Requirements for Installation of Manhole Covers and Sully Gratings, 13 pages.
B. Remme, CAD Dwg., Mar. 10, 1998, Neenah Foundry Company, Neenah, WI U.S.
Neenah Foundry Company, Airport Utility Frames, 1 page, Neenah Foundry Company, Neenah, WI, U.S.

*Primary Examiner*—Naoko Slack
*Assistant Examiner*—Chi Q. Nguyen
(74) *Attorney, Agent, or Firm*—Quarles & Brady LLP

(57) ABSTRACT

A hatch cover with spring assembly to assist in lifting open the hatch cover lid. The lid is hinged to a frame so it can be rotated about the hinge to an open position. A spring or a pair of springs are attached to the underside of the lid. Each spring is a torsion spring having one arm selectively attached to the lid, and another arm in sliding contact with the frame. For ease of repair or replacement, the spring is attached only to the lid. In addition, attaching the spring to the lid allows the spring to retract when the lid is opened. The method for assembling the hatch includes the step of selectively attaching the spring to the lid underside. This step may be performed when the lid is detached from the frame.

14 Claims, 14 Drawing Sheets

U.S. PATENT DOCUMENTS 5,771,539 A * 6/1998 Wahlstedt et al. ..... 16/285
5,788,406 A 8/1998 Hernandez
5,927,012 A 7/1999 Cermola et al.
5,937,583 A * 8/1999 Lamperti ..... 49/386
5,950,368 A * 9/1999 Bradford ..... 52/20
6,041,553 A * 3/2000 Joyce et al. ..... 49/504
6,442,896 B1 * 9/2002 Chapin, III ..... 49/193
6,609,750 B1 * 8/2003 Cauduro ..... 296/216.02
6,718,692 B2 * 4/2004 McKernan ..... 49/67
6,749,363 B1 * 6/2004 Petersen ..... 404/25
6,848,226 B1 * 2/2005 Boyd et al. ..... 52/220.8
6,883,680 B2 * 4/2005 Hirose ..... 220/830

* cited by examiner

ACCESS HATCH COVER ASSEMBLY WITH LIFT-ASSIST ASSEMBLY AND METHOD THEREFOR

BACKGROUND OF THE INVENTION

This invention relates generally to a cover for hatches, manholes and the like, and more particularly to a hatch cover with a spring assembly to assist in lifting the hatch cover lid. A method of assembling the spring assembly is also disclosed.

Today, sewers, subway systems, electrical wiring, plumbing, and a host of other modern necessities are located underground. These necessities require the capability of being accessed. As such, openings large enough to accommodate individuals, equipment, pallets of material or the like are commonplace. These openings generally take the form of manholes or hatches.

Many manholes or hatches must be covered because they are needed in places where they are crossed over by pedestrians, cars, trucks, and even aircraft. The covers on the manholes or hatches must be heavy enough so that the air or water pressure inside the cavity beneath them will not lift the cover off the opening. More important, covers need to have sufficient structural integrity so that they will not be compromised under the weight of vehicles passing over them.

Covers for openings along streets, roadways, runways, and the like are constructed of iron, steel, aluminum, concrete, plastic or other strong materials. Such covers may weigh several hundred pounds depending on the size of the opening needed to access the cavity. Periodically, covers are lifted so that the cavity can be accessed. Due to the weight of the covers, service personnel must normally work in pairs or use additional equipment to ensure safe handling of the covers.

Attempts have been made to solve the problem of safely and easily opening and closing the covers of the underground openings. These attempts involve using covers with spring-biased assemblies to assist in the lifting of the covers. For example, in U.S. Pat. No. 5,788,406, issued to Hernandez on Aug. 4, 1998 shows a device to assist in the opening of a manhole cover. In Hernandez, a spring and pivot rods are attached to both a cover and a stepped skirt that is seated into the opening. The cover may be lifted so that a worker may access the opening. However, the diameter of the stepped skirt is much larger than the actual opening diameter, and the biasing mechanism appears somewhat complex. Both characteristics add to the expense of the entire cover.

A simpler prior art device is shown in FIG. 1. The biasing assembly "B" is connected to the wall "W" defining the opening, and to the cover "C." Walls are commonly constructed from concrete, see partial wall "W" shown by way of example. These hinged covers have a spring "S" mounted to the wall of the structure and/or frame. However, there are several disadvantages with this particular design. First, the biasing assembly B encroaches into the opening, which requires workers to negotiate the assembly when entering or exiting the openings. Such negotiation is made more difficult if the opening is small and the worker is carrying tools and equipment. Second, this post construction modification can place a stress concentration at or near the attachment site. Over time, material fatigue may cause failure of the spring mounting assembly and/or failure of the fasteners used to connect it to the wall. In addition, the pressure from the spring can cause the frame to break free form the surrounding concrete.

Other prior art spring assemblies are often post construction modifications for existing hatches or manholes. However, it is more complicated to retrofit a spring assembly onto an existing hatch or manhole that one that is already in existence. Further, spring-biased assemblies such as that shown in FIG. 1 can be difficult to service because the spring is connected to the wall W and cannot be practically removed from the opening without damage.

Accordingly, a need exists for a spring assembly for lifting lids of hatch or manhole covers, such assembly containing a minimal number of parts to reduce complexity and/or costs associated with manufacturing and servicing of the assembly. Further, a need exists for a spring assembly that does not significantly impede workers, equipment and other items from entering and exiting the opening.

SUMMARY OF THE INVENTION

The present invention provides for a spring assembly for a hatch cover that is cost-effective, does not substantially interfere with the opening of the cover, and solves the problems raised or not solved by existing designs.

The invention generally comprises a hatch cover with a lid that is hinged to a frame. Generally, a spring assembly is attached to the underside of the lid so that it only makes sliding contact with the frame. One advantage of this construction is that the spring assembly can be removed or replaced with speed and ease. Another advantage is that by attaching the spring to the lid, the spring body moves out of the way of the opening as the lid opens, making it easier for people or objects to move through the hatch.

In one aspect of the invention, the lid has several rings aligned across a rear edge of the underside of the lid, near the hinged connection. A torsion spring, with a clip arm and a spring arm extending from opposite ends of the spring body, is attached to the underside of the lid so that the spring body is aligned with the rings. The clip arm is selectively connected to the underside of the lid, and the spring arm extends outwardly so that when the lid is in a resting open position, the spring arm makes contact with the frame. A spring support extends through the spring and rings to keep the spring in place with respect to the lid. Closing the lid winds the spring. Thus, the spring biases the lid toward an open position to assist a person in opening the lid. Multiple springs may be used rather than a single spring.

In another aspect of the invention, the spring is attached to the lid with a different structure. Either one or a pair of spring receptors are attached to the underside of the lid near the hinge, instead of having rings attached to the lid underside, and having a separate spring support that extends through the rings. The spring receptors are shaped so that the spring body can slide thereon and be held selectively in place by securing the clip arm to the lid. As in the previous embodiment, the spring biases the lid toward an open position.

In yet another aspect of the invention, the structure to which the spring is attached encloses the spring coil.

In any of the above embodiments, the hatch may include a latch to keep the lid shut, and a safety arm to keep the lid open. In addition, the lid to which the spring or springs may be attached may be made in various shapes.

The method of assembling the hatch is as follows. The underside of the lid is made accessible. If a ring/spring support attachment is used, the clip arm of each spring is attached to the lid underside so that each spring body is aligned with the rings. The spring support is slid through each spring body and the rings. The spring support is selectively locked into position. The spring arm is in a position so that it can slidingly engage the frame as the lid opens and closes.

If the spring receptor(s) are used, each spring is slidingly placed onto a spring receptor and the clip arms selectively locked to the lid underside so that each spring will not slide out of place. As described above, each spring arm is in a position so that it can slidingly engage the frame as the lid opens and closes.

If the spring receptor encloses the spring, each spring is inserted into the spring receptor. The clip arm extends through an aperture in the spring receptor and secured so that it will not slide out of place. Each spring arm is positioned to extend from the spring receptor and slidingly engage the frame.

While one possible application of the present invention is in connection with airport hatches and hatch covers, many other applications are possible and references to use in connection with airport hatches and hatch covers should not be deemed to limit the scope of the present invention. For example, the invention could be used for manholes, and may be used in city streets, subways, industrial plants, ports or the like. The terms "cover," "rim," "lid," "spring," "safety arm," "opening," "base," or "hatch" as used herein should not be interpreted as being limited to specific forms of a cover, rim, lid, spring, safety arm, opening, base, or hatch. Rather, these elements may have a wide variety of shapes and structures.

These and other objects and advantages of the present invention will become apparent from the detailed description, claims, and accompanying drawings.

DETAILED DESCRIPTION OF THE PREFERRED EMBODIMENTS

Figure 1:
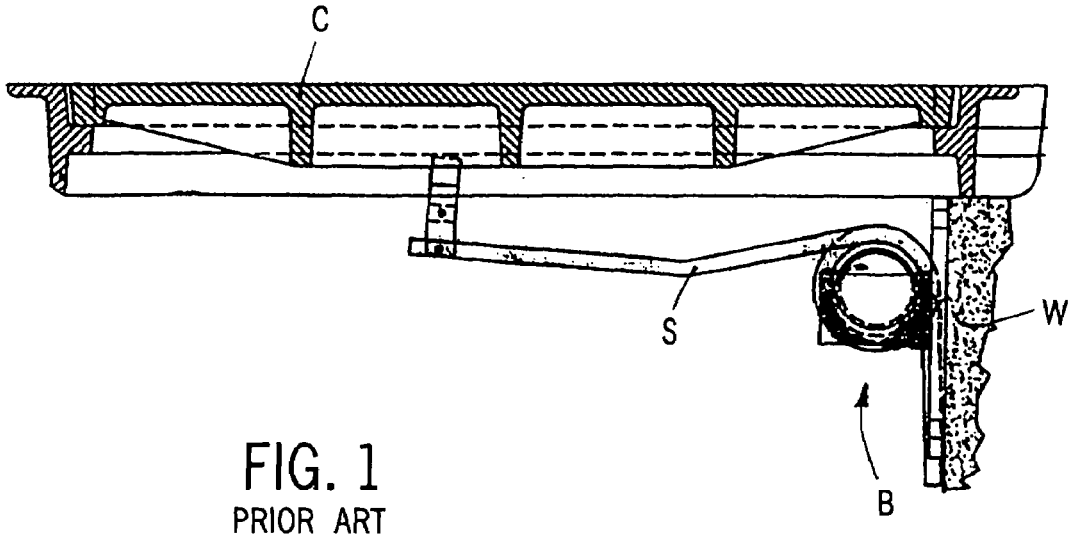
FIG. 1 PRIOR ART
FIG. 1 is a sectional side elevation of a prior art hatch cover with a spring assembly in a closed position.

Illustrative embodiments of a hatch cover (identified generally as 30) in accordance with the present invention are shown in FIGS. 1 through 23. While the invention may be susceptible to embodiment in different forms, there are shown in the drawings, and herein described in detail, certain illustrative embodiments with the understanding that the present disclosure is to be considered an exemplification of the principles of the invention. This specification is not intended to limit the invention to those embodiments illustrated and described herein. Additionally, features illustrated and described with respect to one embodiment could be used in connection with other embodiments.

In general for all embodiments, the hatch cover 30 generally comprises a frame 32, a lid 34 hinged to the frame, and a spring assembly 36 connected to the lid. Frame 32 is adapted to be seated into a cavity opening. For example, the opening may allow access to a sewer or utility tunnel in a public street, or may allow access to a tunnel located in an airport tarmac or hangar. Such openings are typically defined by a concrete wall 38 or the like, as shown by example in FIG. 4. It is not essential to the present invention that hatch cover 30 is set into concrete on site, or set into a concrete frame which is later set into a particular site. The frame 32 and lid 34 may be formed of any durable material such as metal. Preferably, the frame 32 and lid 34 are formed of iron, steel, aluminum, or the like and most preferably of gray, ductile, or austempered ductile iron. The frame 32 and lid 34 may be manufactured by casting, molding, or any other appropriate method.

Referring to the embodiment shown in FIGS. 2 through 9, frame 32 is most preferably rectangular in shape, and generally constructed from two pairs of opposite and upright side-walls 40*a* and 40*b* connected together to form four corners 42. Of course, the side-walls 40*a* and 40*b* are may be curved rather than straight, and are not necessarily equal in length. Alternative frame shapes include, but are not limited to, trapezoids, truncated circles or squares. The only limit to the shape of frame 32 is to any shape that allows the spring assembly 36 to function as described below.

Figure 2:
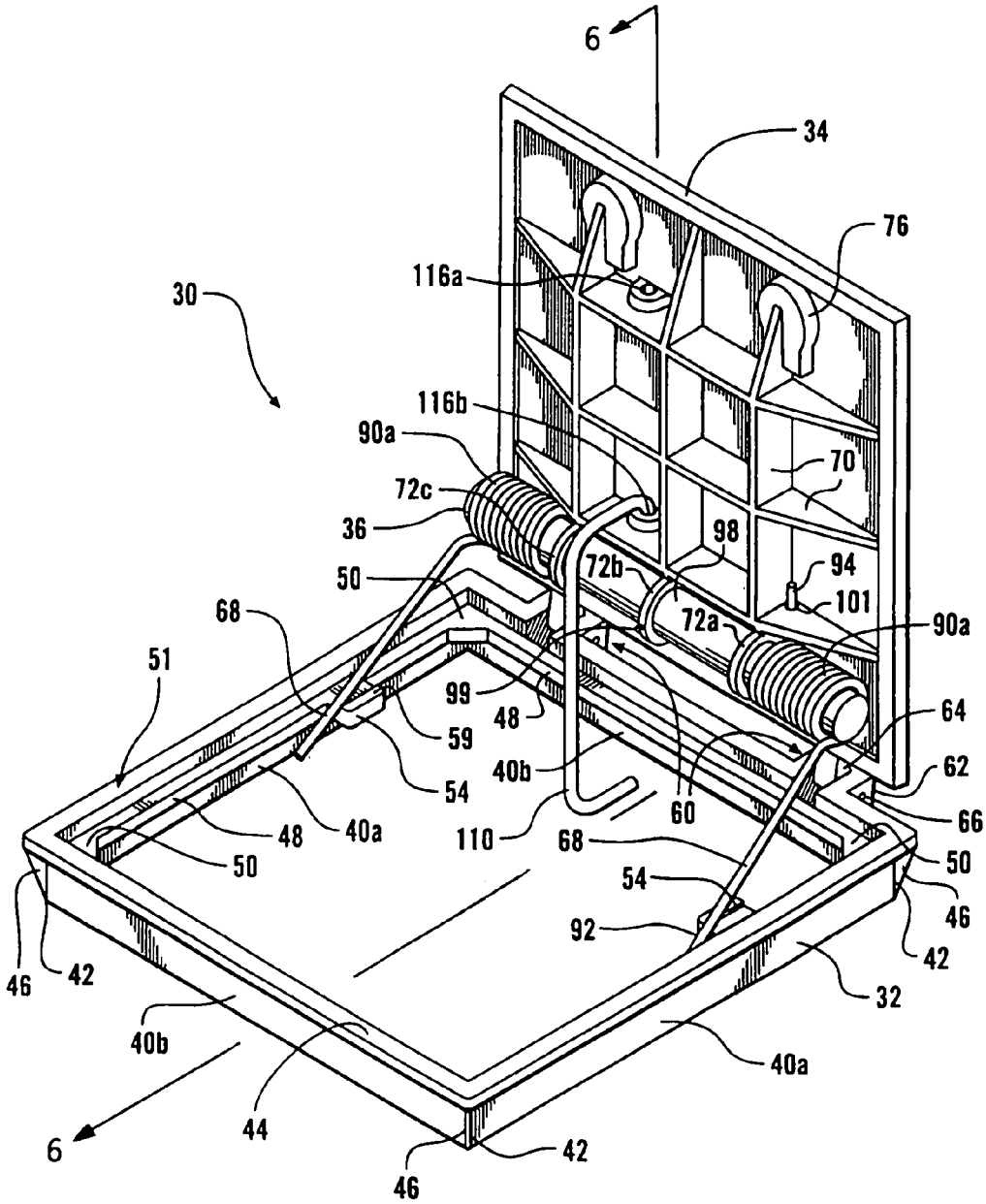
FIG. 2 is a front perspective view of one embodiment of a hatch cover secured in an open state by an optional safety arm, showing a lid, a rim, and a spring assembly of the present invention.
Figure 4:
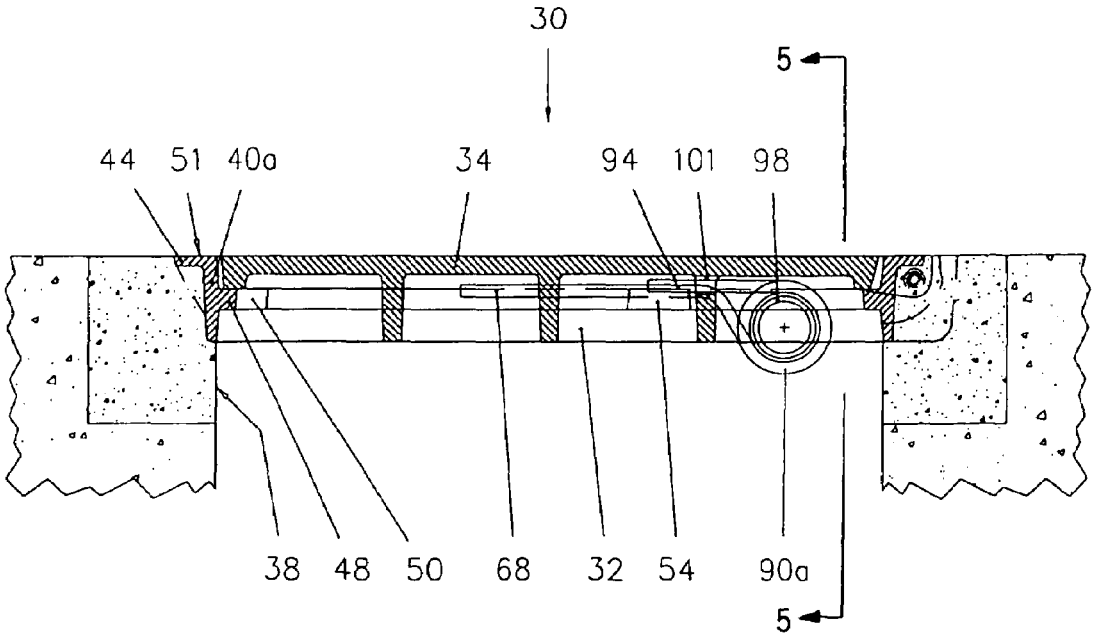
FIG. 4 is sectional side-elevation view of the hatch cover of FIG. 2, with the cover in a fully closed state, without the optional safety arm.
Figure 5:
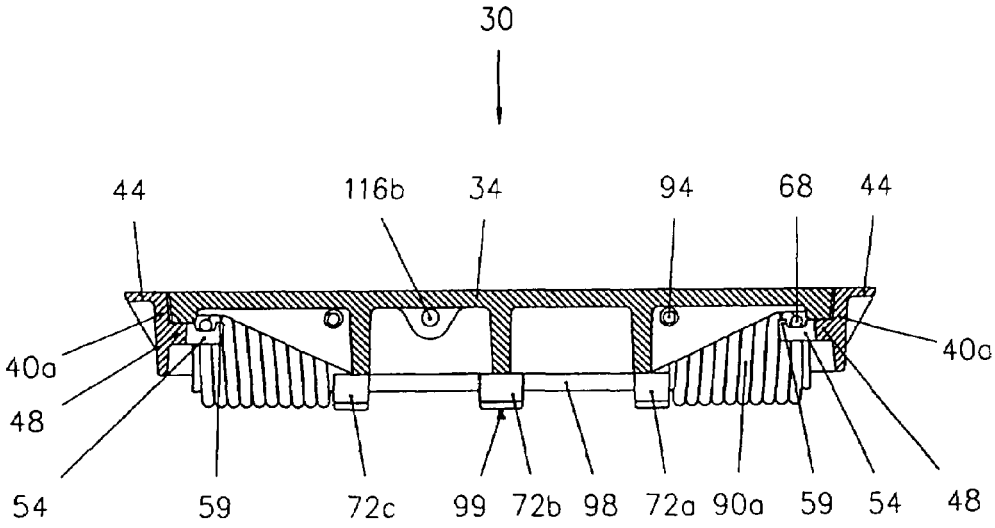
FIG. 5 sectional rear-elevation view of the hatch cover of FIG. 4 taken in the plane of line 5—5.

Referring to FIGS. 2 and 4, a flange or lip 44 extends at least outwardly from the top edge of each side-wall 40*a*, 40*b*. Lip 44 may be positioned not only at the top edge of the side-walls, but at the bottom edge or anywhere between. Vertical gussets 46 may be used to support lip 44 at each frame coiner 42 for added structural integrity. In addition to lip 44, a seat 48 extends inward around the inner perimeter of the side-walls 40*a*, 40*b*. Seat 48 supports the weight of lid 34 and any added loads thereto when lid 34 is in a closed position. Most preferably, horizontal fillets 50 are located at each corner of the seat for ease of manufacture, structural stability of the overall frame, and reduction of stress concentrations. As seen in FIG. 4, seat 48 is most preferably recessed below the top surface 51 of lip 44. Recessing seat 48 by a distance equal to the thickness of lid 34 will allow the lid to be flush with lip 44 when in a closed position. Though this arrangement is desirable in most hatch/manhole cover applications, the present invention is not limited to lids 34 having a flush fit with respect to frame 32.

Figure 3:
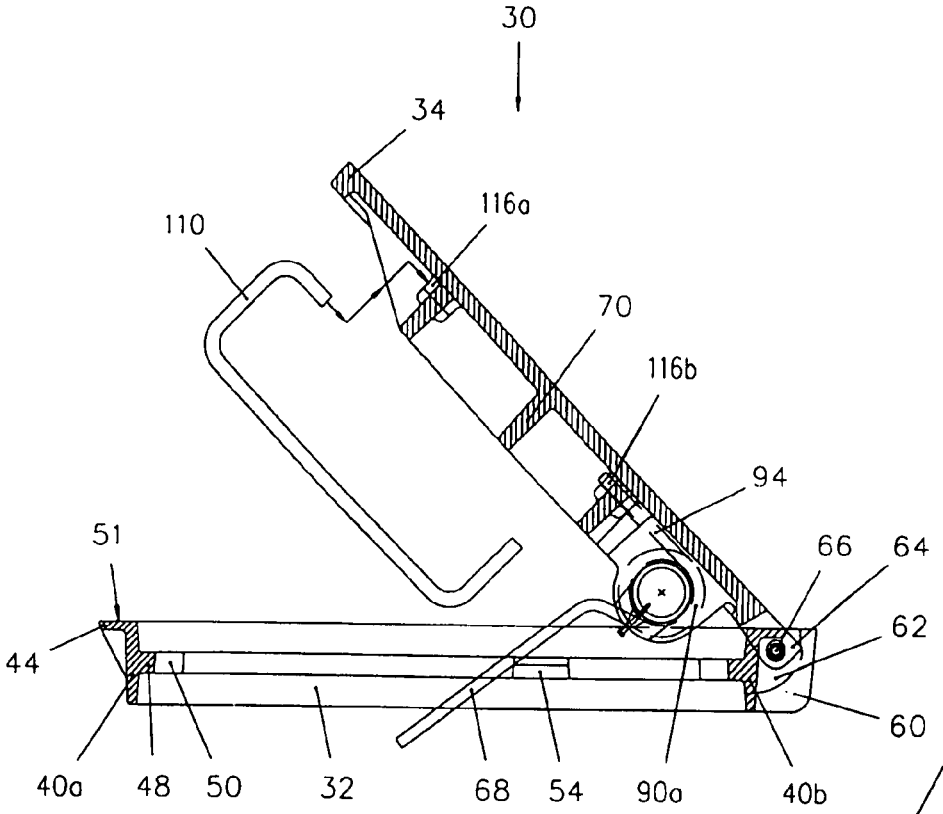
FIG. 3 is sectional side-elevation view of the hatch cover of FIG. 2 taken in the plane of line 6—6, with the cover in a partially closed state, and showing an optional safety arm in a removed position.

Referring now to FIGS. 2–4, a pair of lugs 54 extend oppositely from seat 48 at side-walls 40*a*. Each of the lugs 54 functions as a bearing surface and guide for the spring assembly 36. As will be described more fully herein, a pair of spring arms 68 extend from spring assembly 36 and each bear against a corresponding lug 54 whether the lid 34 is in an open or closed position. Preferably, as seen in FIG. 2, a ridge 59 extends upwardly from the end of each lug 54 so that spring arms 68 do not slip off of lug 54.

Figure 6:
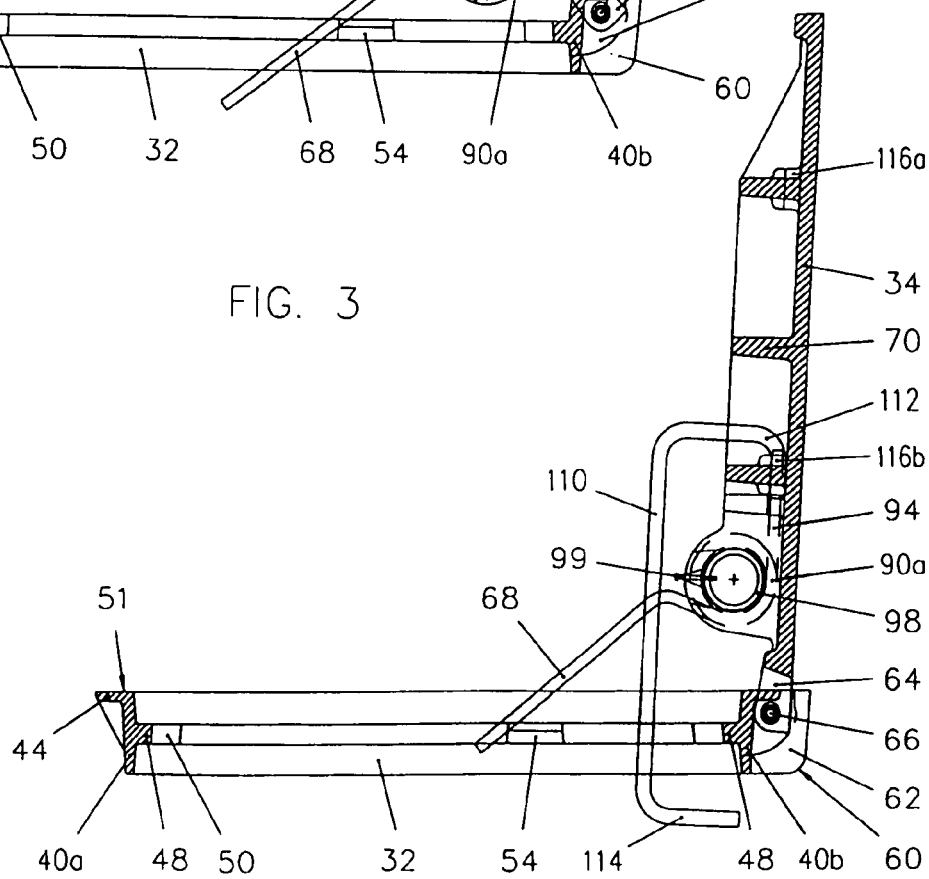
FIG. 6 sectional side-elevation view of the hatch cover shown in FIG. 2 taken in the plane of lines 6—6.
Figure 7:
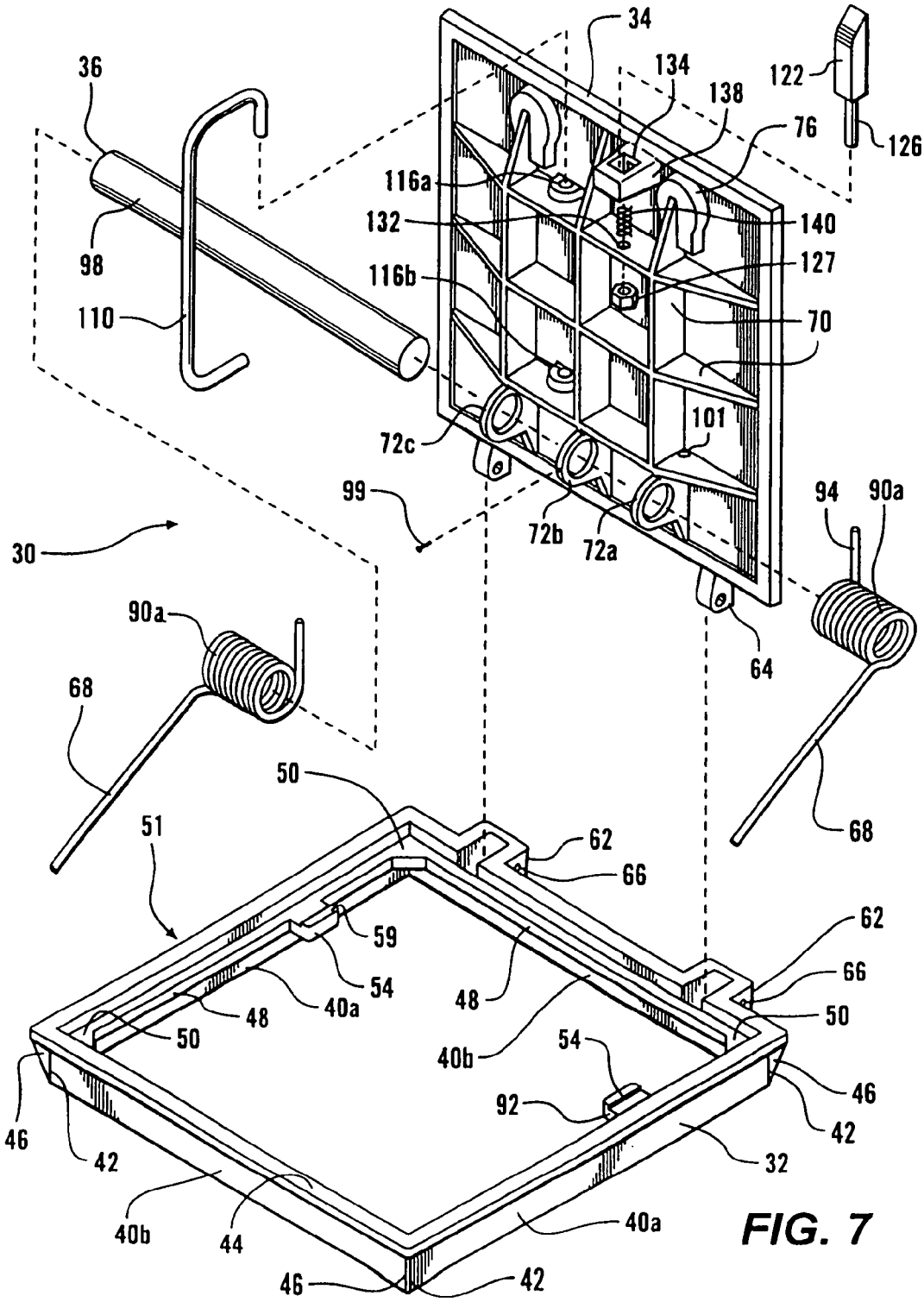
FIG. 7 is an exploded view of the hatch cover shown in FIG. 2, with the addition of an optional latch mechanism.

Referring now to FIGS. 6 and 7, each of a pair of hinges 60 extends from the rear side-wall 40*b*. Lid 34 pivots from an open position to a closed position about hinges 60. Preferably, hinges 60 are constructed from a female hinge portion 62, a male hinge portion 64 and a hinge pin 66. The female hinge portion 62 may extend from the rear side-wall 40*b*, and the male hinge portion 64 may extend from the corresponding rear edge of lid 34. A hinge pin connects the hinge portions 62 and 64. Other types or arrangements of hinges may be used. The type of hinge shown in the FIGS. 2–7 is commonly used for cast, fabricated or molded components.

Figure 8:
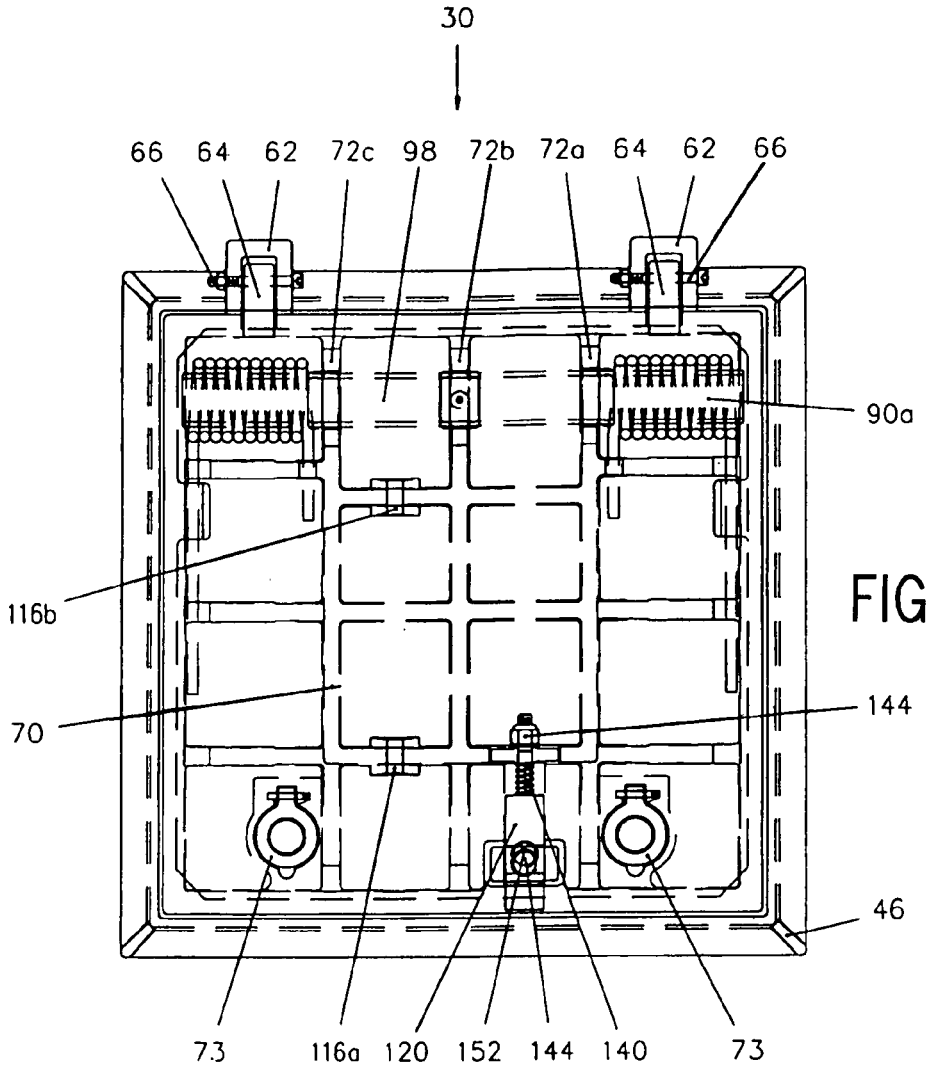
FIG. 8 is a top plan view of the hatch cover shown in FIG. 7, minus the optional safety arm.

Lid 34 may have a grid of ridges or ribs 70 on its underside. Ribs 70 may increase the stiffness of the lid 34, and may be formed in various configurations other than that shown. Lift handles 73 may be located on the top surface of lid 34 as shown in FIG. 8, but are not essential to the present invention. If lift handles are used, there may be handle indents 76 visible from the underside of lid 34, as seen in FIG. 7.

In one embodiment of the present invention as shown in FIGS. 7 and 8, lid lift assistance is provided by a spring 90 and the means used to selectively attach spring 90 to lid 34. Spring 90 is a torsion spring, and is preferably made from stainless steel. Other materials such as spring steel or the like may be used. On the underside of lid 34, adjacent the edge where hinge portions 64 are located, is a series of rings 72 formed integrally with ribs 70 and lid 34. Preferably, three rings 72*a*, 72*b* and 72*c* are used, but this number may vary.

In some instances, only one spring 90 is used. In this case, one of the springs 90 is simply omitted. This is true regardless of which embodiment of lid 34 is used. The number of springs used is generally dependent upon the weight of lid 34, the amount of force required to lift lid 34, and the amount of spring force provided by spring 90.

In the first embodiment shown in FIGS. 2–9, the spring will be designated as spring 90*a*. Spring 90*a* has two arms extending therefrom. The first is a spring arm 68 which extends outwardly from the spring body. The second is a clip arm 94 tangentially extending from the spring body in straight torsion. Preferably, the angle between the spring arm 68 and the clip arm 94 ranges between about 90 to about 130 degrees in a free or equilibrium position. In this embodiment the spring 90 is in a free position when lid 34 is completely open. Spring 90 may have a stiffness such that lid 34 does not shut completely when the only force acting upon the spring is the weight of lid 34. That is, preferably, a force in addition to the weight of lid 34 will be required to shut the lid completely. A person standing on lid 34 may provide adequate force to shut the lid and employ a latch, bolt, lock or other fastener to keep the lid in a closed position. In addition, the stiffness of spring 90 may be selected so that the force of closing the lid 34 shut will enable a latch or other fastener to keep lid 34 in a closed position.

Referring still to the embodiments shown in FIGS. 2–9, a spring support is used to connect spring 90 to lid 34. In the preferred embodiment shown, the spring support takes the form of a cylinder 98 or hollow tube, but other forms, such as a simple bar of any cross section, may also be provided. Cylinder 98 slidably attaches to lid 34 by sliding axially through rings 72, and is held into place with a set screw 99. Preferably, the outer diameter of cylinder 98 is slightly less than the inner diameter of spring 90 when lid 34 is in a closed position. The spring support may be made of any durable material, preferably a metal such as iron, steel, aluminum, or the like, and most preferably galvanized steel.

Figure 9:
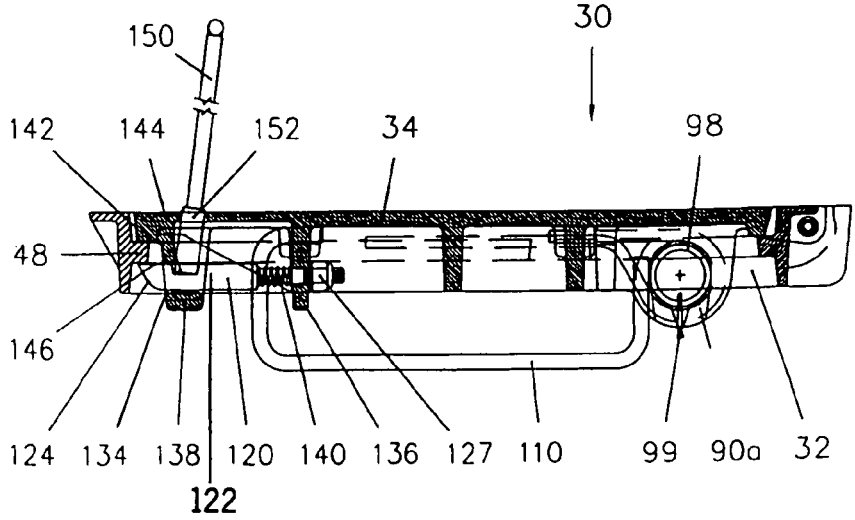
FIG. 9 is a side elevational view of the hatch shown in FIG. 8, taken in the plane of lines 9—9, and showing a pry bar in a position prior to disengagement of the latch; mechanism.
Figure 10:
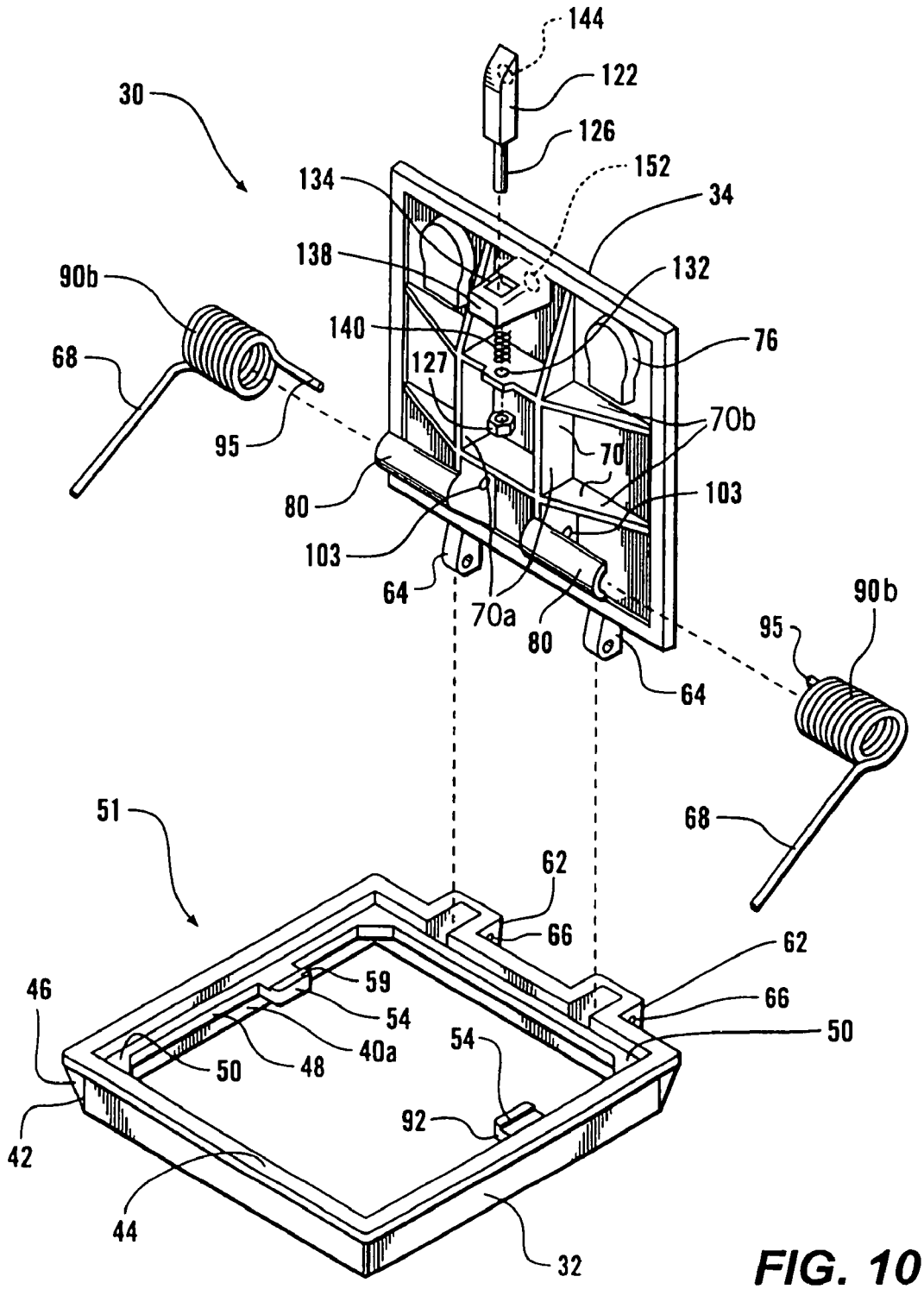
FIG. 10 is an exploded view of a further embodiment of the hatch cover, showing an alternative spring attachment along with an optional latch.

In any of the embodiments as shown in FIGS. 2–9, hatch cover 30 may have a safety arm 110. The purpose of safety arm 110 is to selectively prevent lid 34 from closing. Safety arm 10 is selectively connected to lid 34 either in a stored position as seen in FIG. 9 or in a deployed position as shown in FIG. 6. In the most preferred embodiment, safety arm 110 is J-shaped, made from a bent rod having a first end 112 with two bends and a second end 114 with a single right-angle bend or an acute-angle bend. In the most preferred embodiment the two bends of first end 112 total about 180 degrees. The distal portion of first end 112 may be inserted into an aperture 116*a* or 116*b* located in one of the ribs 70, or the like. Aperture 116*a* is located on the underside of lid 34, far enough from hinges 60 so that lid 34 may completely close when end 112 of safety arm 110 is placed within aperture 116*a*. Aperture 116*b* is located on the underside of lid 34, close enough to hinges 60 so that, when the first end 112 of arm 110 is inserted therein, second end 114 extends downward past the seat 48 and contacts the wall (not shown) of the opening. In use, the user of the hatch 30 may open lid 34, remove first end 112 of arm 110 from aperture 116*a*, and place the first end of the arm into aperture 116*b*, thus permitting second end 114 to contact the wall and by that means secure and support lid 34 in an open position.

To assemble spring 90*a* onto the lid 34 shown in FIGS. 2–9, the following procedure is preferred. Lid 34 is either resting on hinge 62 in an open position or completely detached from the frame. As can be seen by comparing FIG. 2 with FIG. 7, the clip arm 94 of spring 90*a* is placed into aperture 101 located in the rib 70 of lid 34, and the spring arm 68 is in contact with lug 54. This step is repeated if two springs 90*a* are used. Cylinder 98 is slid through the body of each spring 90, and through rings 72*a*, 72*b* and 72*c*, so that it is about centered with respect to lid 34. Cylinder 98 may be kept in place by any suitable means, most preferably with a set screw 99 threaded through one of the rings, central ring 72*b*, and at least into contact with the surface of the cylinder.

The set screw 99 may even penetrate into the surface of the cylinder 99. To replace a spring 90*a*, this procedure is reversed and repeated.

Figure 12:
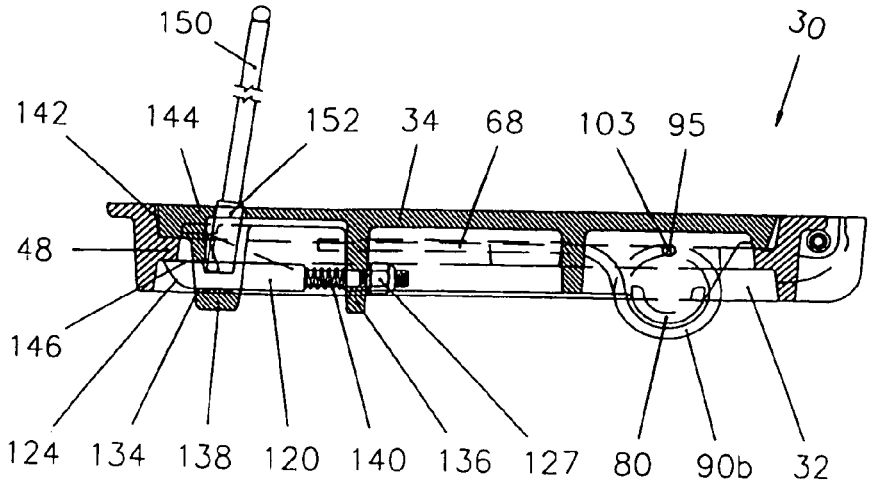
FIG. 12 is sectional side-elevation view of the hatch cover of FIG. 11, taken in the plane of lines 12—12.

Referring now to FIGS. 10–14, a different embodiment of the invention includes spring receptors 80 to connect springs to the lid. In this embodiment, ribs 70 may be present at least to the extent necessary, and configured so as, to support the spring assembly 36. Preferably in this embodiment, two sets of ribs 70 are formed on or attached to the underside of lid 34, a longitudinal set 70*a* and a transverse set 70*b*. The length of ribs 70*a* and 70*b* are such that they fit within the inner perimeter of seat 48. Each spring receptor 80 extends outwardly substantially perpendicular from one or both of the longitudinal ribs 70*a* adjacent the hinges 64. As seen in FIG. 12, in this embodiment a lateral cross-section of spring receptor 80 reveals a profile that is formed in a hemi-cylindrical shape. Preferably the outer surface of receptor 80 has a radius that is the same as, or just less than, the inner radius of the spring 90.

Figure 11:
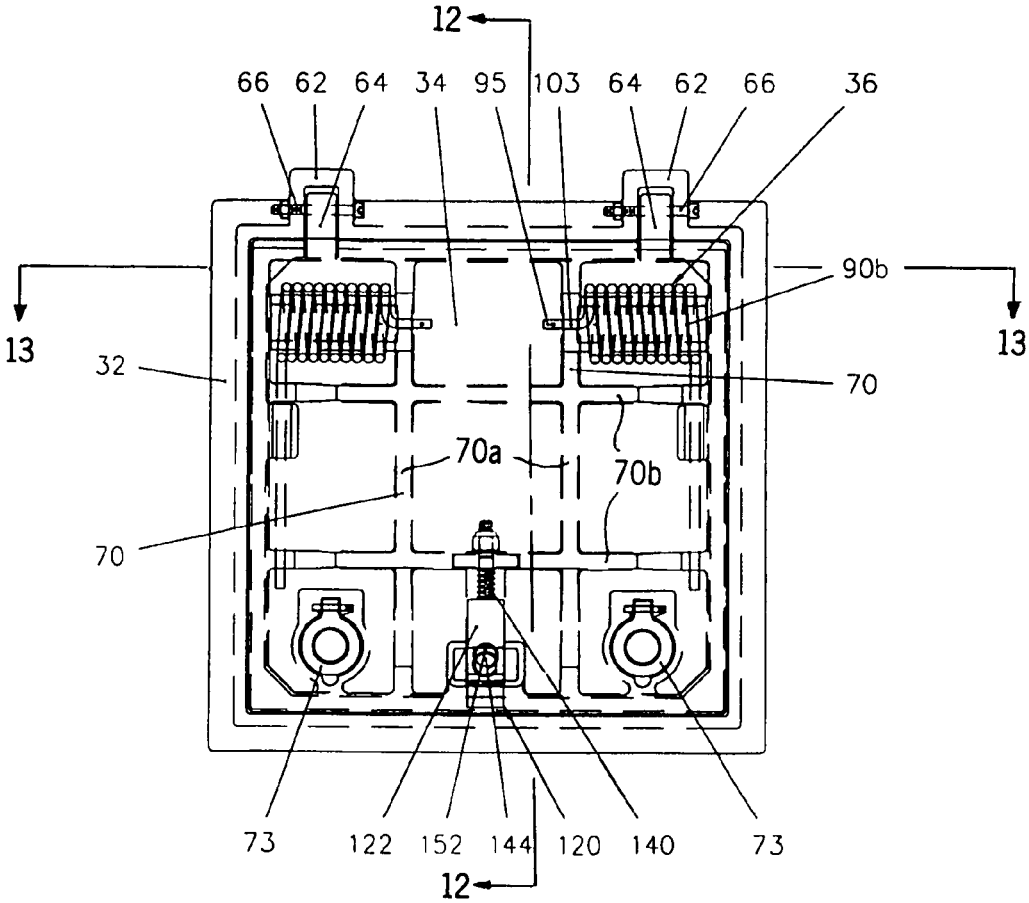
FIG. 11 is a top plan view of the hatch cover shown in FIG. 10, showing the latch in a locked position.
Figure 13A:
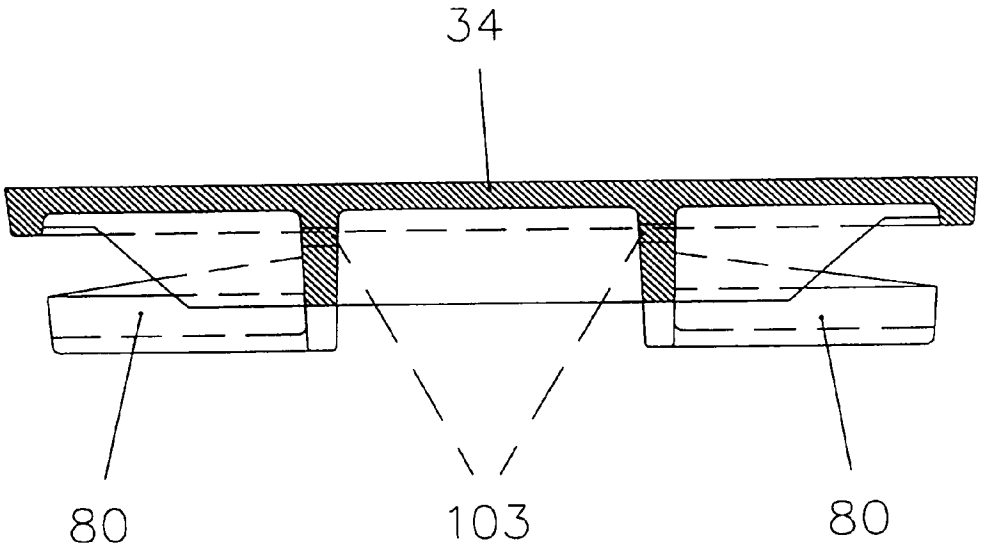
FIG. 13A is a sectional rear-elevation of the lid shown in FIG. 13, without a spring attached thereto.
Figure 13:
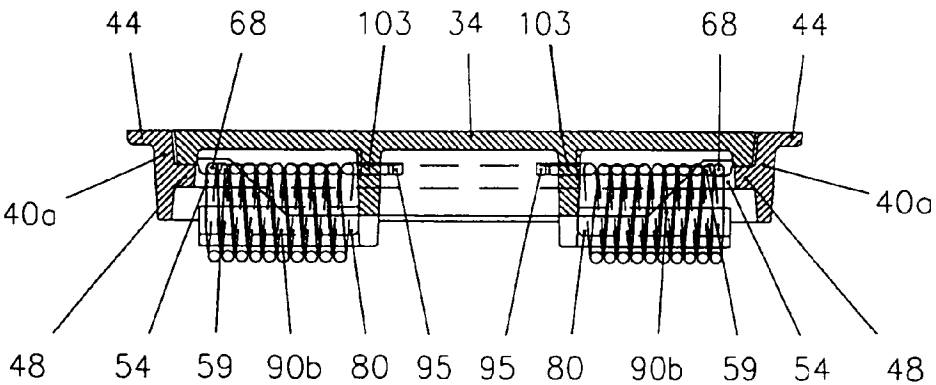
FIG. 13 sectional rear-elevation view of the hatch cover of FIG. 1 taken in the plane of lines 13—13.
Figure 14:
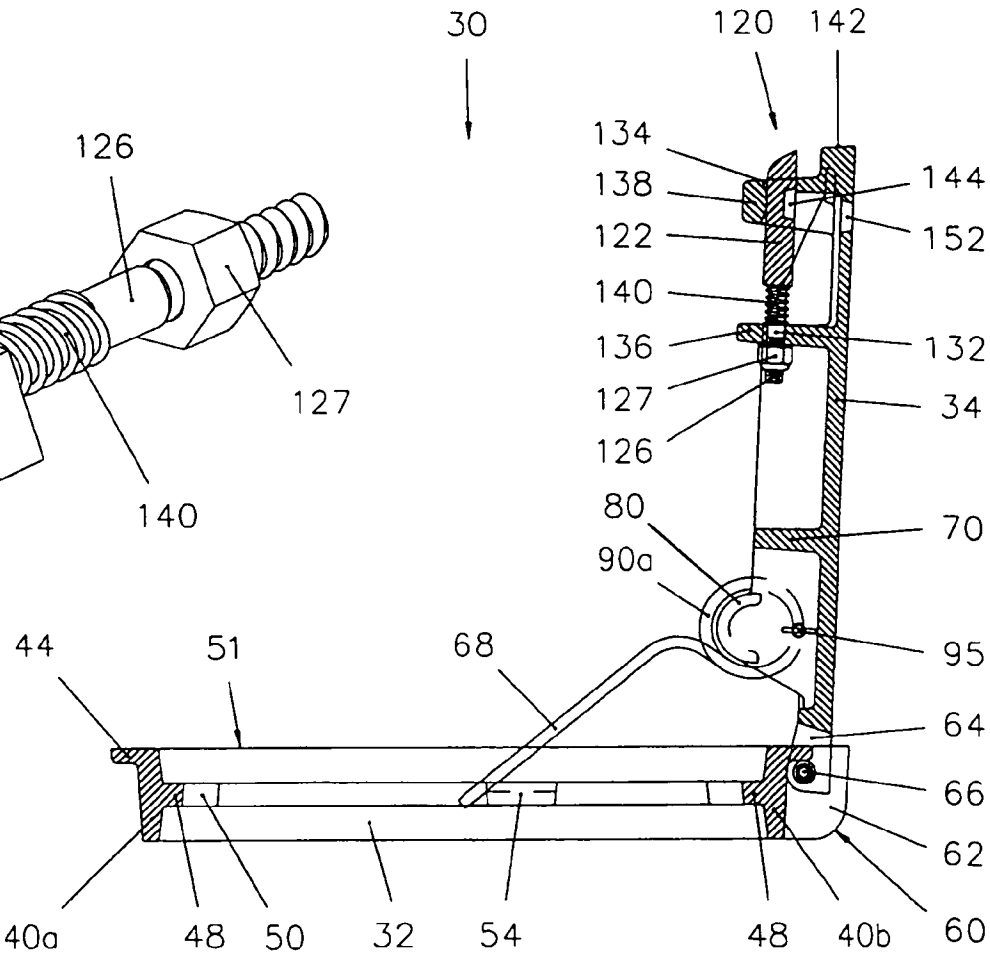
FIG. 14 sectional side-elevation view of the hatch cover shown in FIG. 11, shown in an open position.
Figure 15:
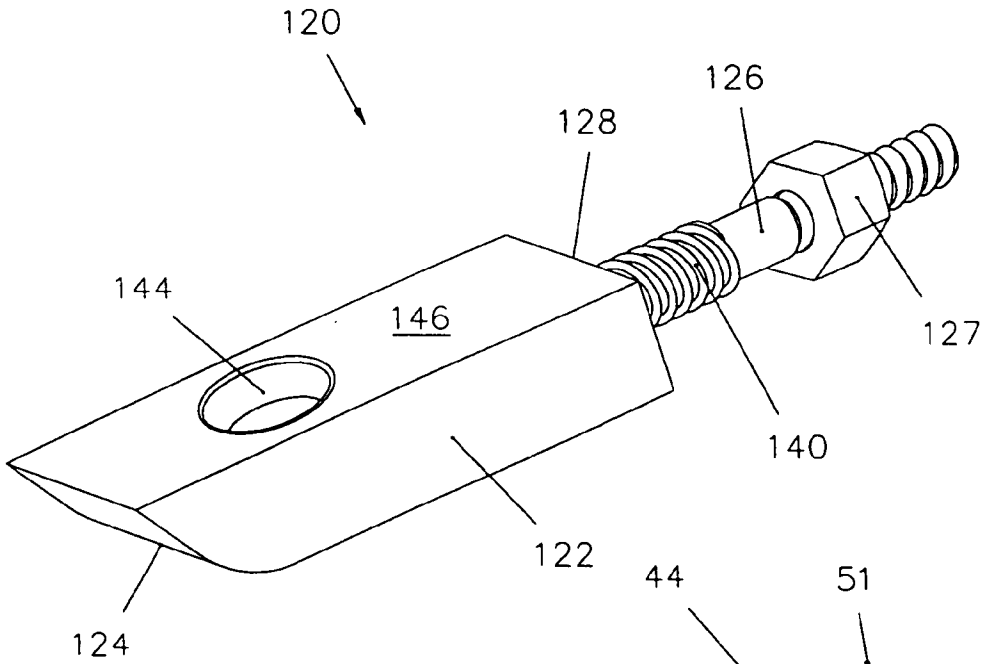
FIG. 15 is a perspective view of the optional latch shown in FIGS. 8–14.

Referring still to the embodiment shown in FIGS. 10–14, spring 90 differs in only one respect, and will be designated as spring 90*b*. Referring to FIGS. 11 and 13, the difference is that the clip arm, designated here as clip arm 95, does not tangentially extend from the spring body in straight torsion, but rather extends away from the spring body generally in the direction of the spring-body axis. The length of clip arm 95 is such that it extends through and beyond an aperture 103 provided for that purpose in the adjacent rib 70*a*. Spring 90*b* is fastened in place, preferably with a cotter pin (not shown) that extends through an aperture located in the distal end of clip arm 95. The cotter pin or other means of fastening substantially prevents clip arm 95 from sliding out of aperture 103, thereby keeping the spring body from moving along the axis of spring receptor 80.

To assemble spring 90*b* onto the lid 34 shown in FIGS. 10–14, the following procedure is used. With lid 34 resting on hinges 62 in an open position, the spring 90*b* is slid onto spring receptor 80 so that clip arm 95 is placed into aperture 103 located in the rib 70 of lid 34, and the spring arm 68 is in contact with or slidingly retained by lug 54. If the spring arm rests atop lug 54, a cotter pin or other fastener is placed on the clip arm 95 of spring 90*b* so that the spring cannot slide off from the spring receptor 80. If lug 54 is designed to slidingly retain spring arm 68, the spring 90 will stay in place without any cotter pin or other fastener. To replace a spring 90*b*, this procedure is reversed and repeated.

Figure 17:
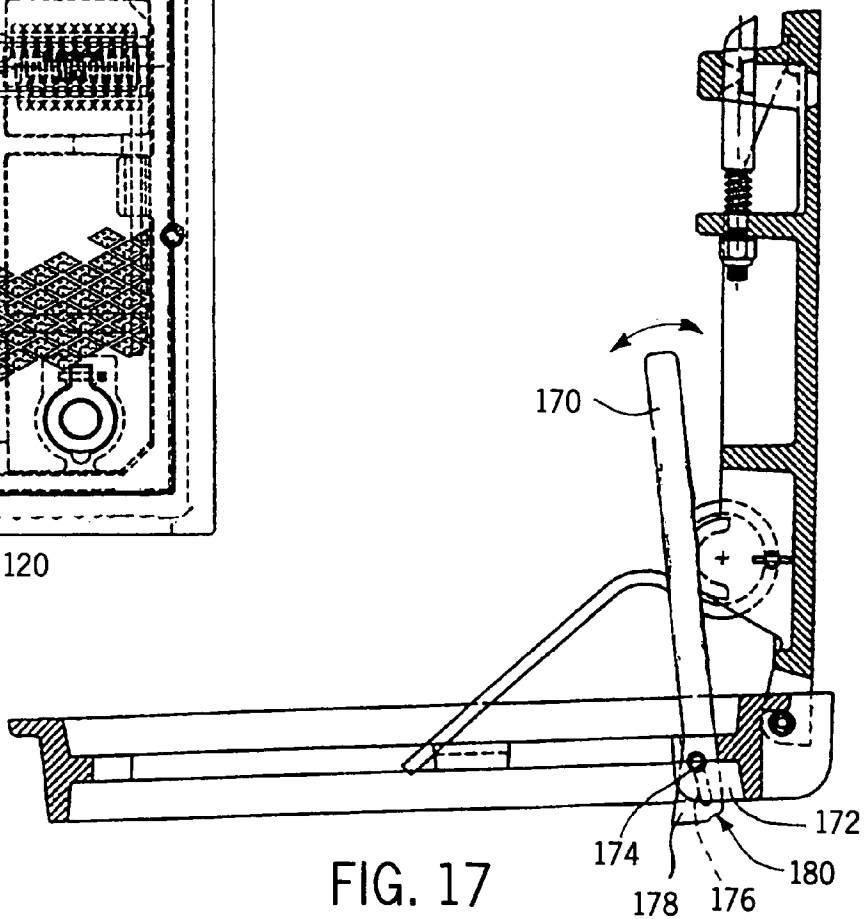
FIG. 17 is a sectional side-elevation view of the hatch shown in FIG. 16, taken in the plane of lines 17—17, except shown with the lid open.
Figure 16:
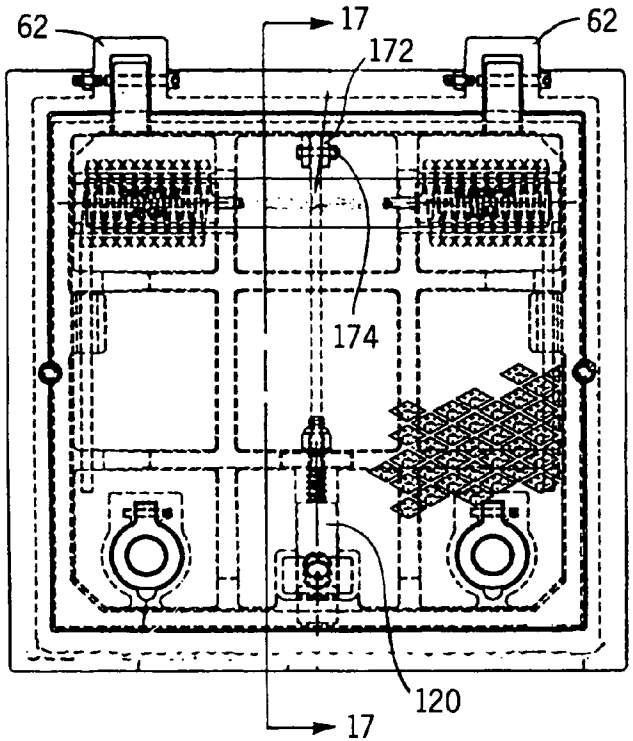
FIG. 16 is a plan view of another embodiment of the hatch showing a swivel safety arm.

Referring now to FIGS. 16 and 17, an alternative embodiment for a safety arm is shown. In this embodiment, safety arm 170 is rotatably connected to the inside surface of frame 32, preferably between hinges 62. Specifically, safety arm 170 is connected to a bracket 172 by extending a hinge pin 174 through the bracket and a slot 176 in the proximal end 178 of safety arm 170. By positioning pin 174 in the most inner end of slot 176, the safety arm is positioned so that lid 34 cannot inadvertently fall closed. By positioning pin 174 in the opposite end of slot 176, the safety arm 170 may be rotated to lie in horizontally in the plane of the frame opening to allow lid 34 to close, or could hang straight down into the opening. The length of safety arm 170 is such that it can be aligned with latch 120. The edge 180 of proximal end 178 is contoured so that it does not interfere with the frame when safety arm 170 is rotated to the horizontal position shown in FIG. 16.

Figure 18:
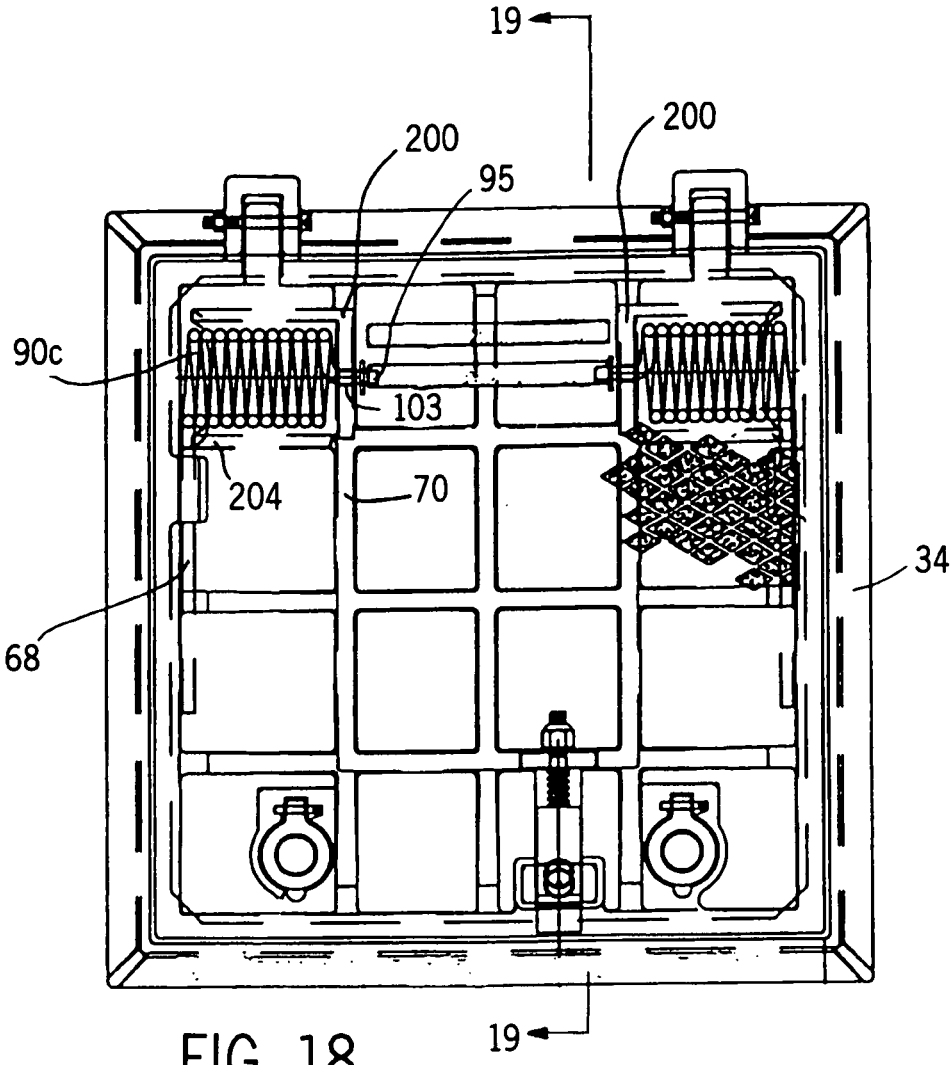
FIG. 18 is a top plan view of another embodiment of the hatch having a different spring receptor.
Figure 19:
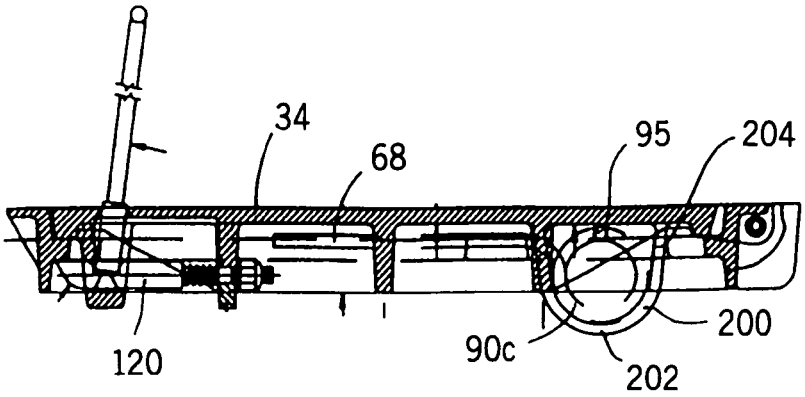
FIG. 19 is a sectional side-elevation view of the hatch shown in FIG. 18, taken in the plane of lines 18—18.
Figure 20:
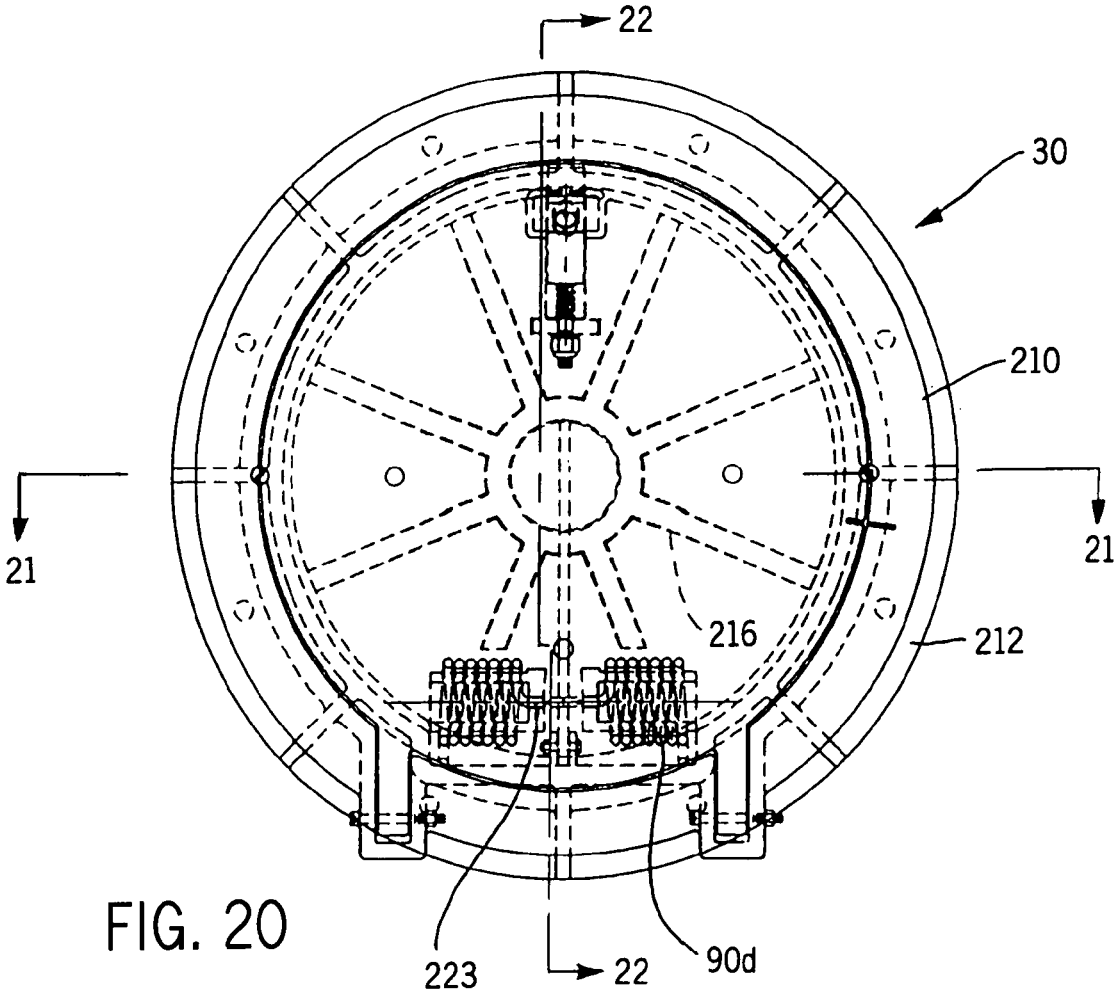
FIG. 20 is another embodiment of the hatch having with a different shape lid and location of the spring assembly.
Figure 21:
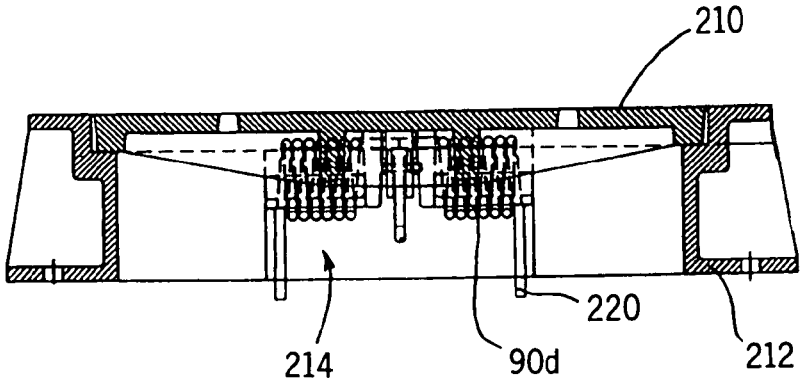
FIG. 21 is a sectional rear-elevation of the hatch shown in FIG. 20, taken in the plane of lines 20—20.

Referring now to FIGS. 18 and 19, another embodiment of the hatch is shown. The only substantive difference between the hatch of FIGS. 18 and 19 and the hatch of previously described embodiments is that spring receptors 200 are provided, for the purpose of receiving a spring in the interior thereof. That is, spring receptors 200 replace rings 72 (*a*–*c*) and cylinder 98 of the embodiment shown in FIGS. 2 through 9, and also replace the spring receptors 80 of the embodiment shown in FIGS. 10 through 14. Spring receptors 200 are preferably cast integrally with lid, and have a hemi-cylindrical cross section so that the curved portion 202 substantially corresponds with the shape of spring 90*c*. The side walls 204 extending from the curved portion 202 may extend between a rib 70 and the spring arm 68 extending from spring 90*c*. Spring 90*c* is substantially the same as spring 90*b* shown in FIG. 10. Spring receptors 200 may be used with differently shaped lids 34.

To assemble spring 90*c* onto the lid 34 shown in FIGS. 18 and 19, the following procedure is used. Lid 34 is set up in hinge 62 in an open position. The spring 90*c* is slid into spring receptor 200 so that clip arm 95 is placed into aperture 103 located in the rib 70 of lid 34, and the spring arm 68 is in contact with or slidingly retained by lug 54. If the spring arm rests atop lug 54, a cotter pin or other fastener is placed on the clip arm 95 of spring 90*b* so that the spring cannot slide off from the spring receptor 80. If lug 54 is designed to slidingly retain spring arm 68, the spring 90 will stay in place without the cotter pin or fastener. To replace a spring 90*c*, this procedure is reversed and repeated.

Yet another embodiment of the invention is shown in FIGS. 20–23. Here the hatch cover 30 generally comprises a lid 210, a frame 212 and a spring assembly 214. Lid 210 is attached to frame 212 at hinges 215. Lid 210 is similar in construction to lid 34, except that is circular in shape and has radial ribs 216. Spring assembly 214 is located near the edge of lid 210. The spring assembly 210 shown is very much like that shown in FIG. 10 except that the springs may be smaller in length. That is, in this embodiment spring receptor 221 is constructed similarly to spring receptors 80. However, the spring receptors could be adapted so that they work similarly to those shown in FIG. 7 or 18.

Figure 22:
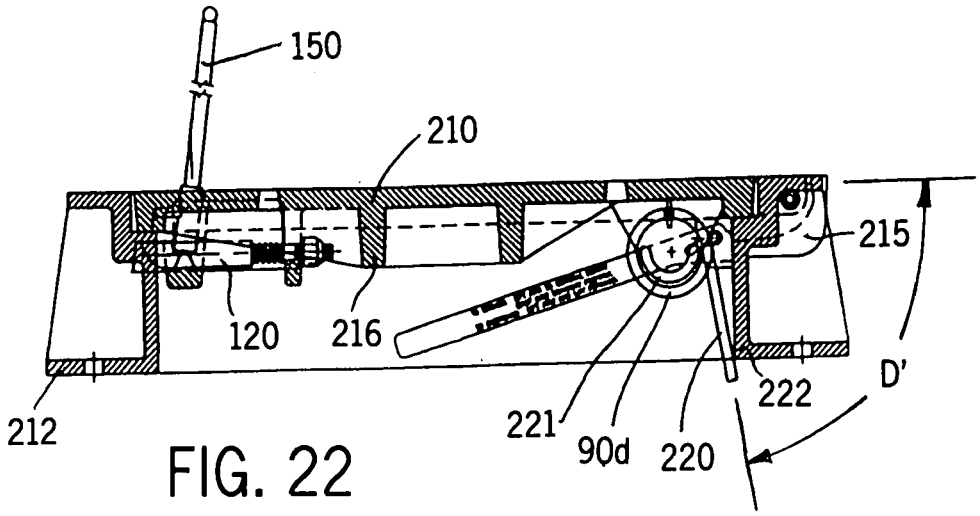
FIG. 22 is a sectional side-elevation of the hatch shown in FIG. 20, taken in the plane of lines 22—22.
Figure 23:
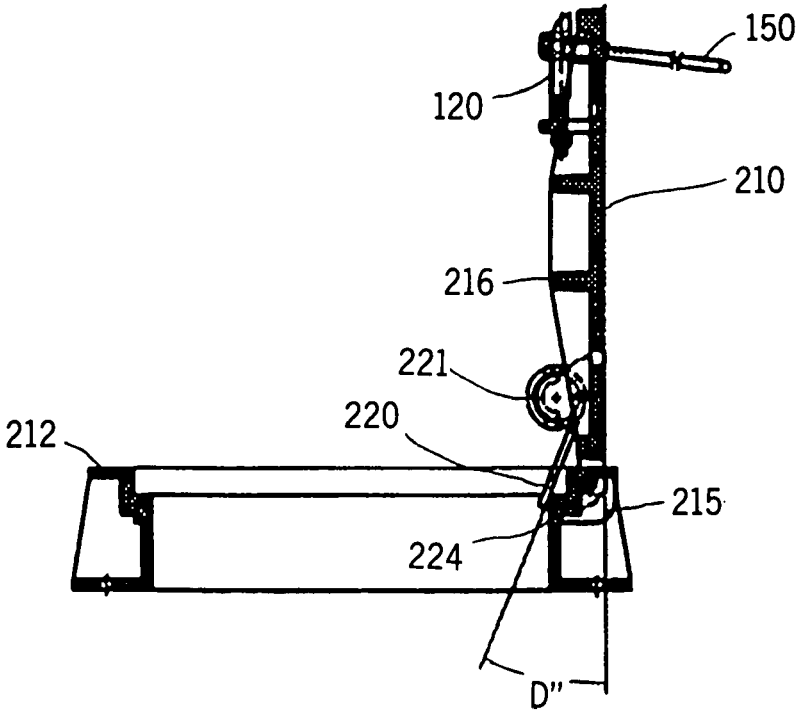
FIG. 23 is a sectional side-elevation of the hatch shown in FIG. 22 with the lid in an open position, having the optional safety arm removed.

The spring arm 220 is preferably oriented so that it slides against the inner wall of frame 212 when the lid is positioned from an open to a closed position. Specifically, as seen in FIG. 22, spring arm 220 rests against the edge 222 of frame 212 when in a closed position. In the alternative, spring arm 220 rests against edge 224 when in an open position. Most preferably, the angle between the spring arm 220 and lid 210 is about 80 degrees when the lid is closed, and about 22 degrees when the lid is open. These angles are indicated in FIGS. 22 and 23 as D' and D" respectively.

To assemble spring 90*d* onto the lid shown in FIGS. 20–23, the spring 90*d* is slid onto spring receptor 221 so that clip arm 223 extends therethrough where it is subsequently locked or secured. Spring arm 221 is oriented so that it is in contact with frame 212. To replace a spring 90*d*, this procedure is reversed and repeated.

Referring to FIGS. 7, 8, 10, 11, 15, 18 and 20, this invention provides for an optional latch 120. The purpose of latch 120 is to lock or keep lid 34 in a closed position. Latch 120 may be incorporated into any of the embodiments discussed supra. Referring to the embodiment shown in FIG. 15, latch 120 preferably has a body 122 with a curved or wedge-shaped leading edge 124 and a means for removable attachment 126, such as a threaded rod, extending from a rear edge 128. Referring to FIGS. 8 and 9, as an example, latch 120 is attached to lid 34 at an aperture 132. A slot 134 is preferably located in the adjacent structure of the lid 34, namely in rib 136. A latch receptor 138 is thereby formed. The latch is assembled by placing a compression spring 140 onto rod 126, and then placing rod 126 into the aperture 132 located in rib 136. Latch 120 is fastened to lid 34, with a nut 127 if the attachment means is a threaded rod, and otherwise by other removable means. In any event, the components are assembled so that compression spring 140 is in a compressed state. Whenever latch 120 is activated during the opening or closing of lid 34, spring 140 biases the latch toward the front edge 142 of lid 34. The body 122 of latch 120 extends through the slot 134 located in rib 138.

The operation of the latch 120 can be described with reference to FIG. 9. As can there be seen, the top surface 146 of body 122 engages the underside of seat 48 when lid 34 in a closed position. An indent 144 is located on the top surface 146. A pry bar 150 may be inserted through an aperture 152 located in the indent 144 to move the top surface 146 out of contact with seat 48. This will release latch 120 and allow lid 34 to open. Preferably, lid aperture 152 is offset within detent 144 so that pry bar 150 can pivot toward the front edge 142 of lid 34 at aperture 152. Regardless of embodiment, latch 120 is operated in a similar manner. Further, in alternative embodiments, latch 34 may instead take the form of a locking mechanism operated by use of a key (not shown), or the like. To operate a lid 34 that does not include latch 120 as shown herein, the user first disengages the lock or other fastener (not shown) keeping lid 34 in a closed position, and reengages this lock or fastener once the lid 34 is ready to be closed and locked down.

The operation all of the embodiments of hatch 30 that include a latch 120 is as follows. First, a user inserts the pry bar 150 into a lid aperture 152, as seen in FIG. 9 or 12. The user pulls the pry bar 150 toward the front edge 142 of lid 34 to release latch 120. Lid 34 will pop open to a position that depends on the stiffness of the spring or springs 90 and the weight of lid 34. Lid 34 is pulled back so that it rests against hinges 62. The optional safety arm 110, if present, may then be removed from aperture 116*a* and placed into aperture 116*b* to prevent lid 34 from being knocked from its resting position, as seen in FIG. 2.

To close lid 34, safety arm 110, if present, is first removed from aperture 116*b* and replaced into aperture 116*a*. Lid 34 is rotated on hinges 60 toward a closed position. The user may stand on lid 34 or apply other force to lid 34 so that it closes completely. As lid 34 is closing, the curved or wedged leading edge 124 of latch 120 makes contact with seat 48. This causes latch body 122 to slide away from seat 48 until body 122 is located below seat 48, thereby further compressing the spring 140. When the leading edge 124 clears the seat 48, the spring 140 moves latch body 122 forward so that the latch upper surface 146 is securely located under the seat.

It should be understood that the ribs 70 are not essential to the present invention. Though ribs 70 are described in both embodiments as being used for the connection of items including the clip arm 94, latch 120, safety arm 110, cylinder 98, etc., ribs 70 can be replaced by individual brackets (not shown) that are attached to the underside of the lid and adapted to receive such items. The term "bracket" is used in a general sense to mean a structure for holding or attaching another structure to the lid 34. Preferably, the individual brackets would be integrally connected to the lid. For example, in the case where ribs 70 are not present in the first embodiment, rings 72, which are in effect brackets, could be attached to or integrally connected with lid 34.

From the foregoing description, it can be seen that the hatch cover 30 provided by the invention is simply constructed. It has a minimum number of parts, especially moving parts. It can be made from relatively inexpensive but durable materials such as steel and iron by molding, casting, or other conventional methods. It allows for easy replacement of the spring. It can assist and support the opening of heavy lids and covers.

The spring assist for lifting lids of the present invention may have other applications aside from use in connection with hatches and manholes. Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims.

We claim:

1. A hatch for access to an opening in the ground or floor comprising:

a frame;

a lid having an underside and a topside, the lid rotatably attached to the frame to selectively move between a closed position and an open position;

a spring support connected to the underside of the lid; and at least one spring including a coil portion, a clip arm, and a spring arm, wherein the clip arm is attached to the lid and the spring arm makes contact with the frame such that the coil portion moves with the lid away from the frame when the lid is in the open position; and wherein the spring biases the lid toward the open position.

2. The hatch of claim 1 further including at least two rings located on the underside of the lid, wherein the spring support is slidably connected to the lid at the rings.

3. The hatch of claim 2 wherein there are three rings attached to the underside of the lid and aligned to slidably receive the spring support.

4. The hatch of claim 1 wherein there is at least one rib attached to the underside of the lid, and having an aperture therein to receive the clip arm.

5. The hatch of claim 1 wherein a lug extends inwardly from the frame to guide and support the spring arm as the lid moves.

6. The hatch of claim 1 further including a safety arm that is attached to the hatch, and movable from a storage position to a locking position to prevent the lid from being closed.

7. The hatch of claim 1 further including a latch connected to the underside of the lid.

8. A hatch for access to an opening in the ground or floor comprising:

a frame;

a lid having an underside and a topside, the lid hingedly attached to the frame to move between a closed position and an open position;

a spring receptor connected to the underside of the lid; and at least one spring connected to the spring receptor, the spring including a coil portion, a clip arm, and a spring arm, wherein the clip arm is selectively attached to the lid, and the spring arm makes contact with the frame;

wherein the spring biases the lid towards an open position; and wherein the coil portion is configured to rotate with the lid as the lid is moved from the closed position to the open position.

9. The hatch of claim 8 wherein the spring is slidably connected to the spring receptor.

10. The hatch of claim 9 wherein the spring receptor extends from a rib attached to the underside of the lid.

11. The hatch of claim 10 wherein the rib has an aperture therein to receive the clip arm.

12. The hatch of claim 8 wherein a lug inwardly extends from the frame to guide and support the spring arm as the lid moves.

13. The hatch of claim 8 further including a safety arm that is selectively attached to the lid, and movable from a storage position to a locking position to prevent the lid from being closed.

14. The hatch of claim 8 further including a latch connected to the underside of the lid.

* * * * *